US005839157A

United States Patent [19]

Strauser et al.

[11] Patent Number: 5,839,157

[45] Date of Patent: Nov. 24, 1998

[54] STREET SWEEPER PICK-UP HEAD

[75] Inventors: Daniel P. Strauser, Elgin, Ill.; Robert E. Field, Newark, Ohio

[73] Assignee: Elgin Sweeper Company, Elgin, Ill.

[21] Appl. No.: 642,196

[22] Filed: May 6, 1996

[51] Int. Cl.[6] ..... E01H 1/08

[52] U.S. Cl. ..... 15/347; 15/340.1; 15/415.1; 15/418

[58] Field of Search ..... 15/340.1, 340.3, 15/415.1, 418, 420, 347

[56] References Cited

U.S. PATENT DOCUMENTS

| | | | |
|---|---|---|---|
| 3,257,786 | 6/1966 | Norris | 15/420 X |
| 3,634,904 | 1/1972 | Larsen | 15/340.1 |
| 3,636,585 | 1/1972 | Larsen | 15/340.3 X |
| 4,160,302 | 7/1979 | Hirst et al. . | |
| 4,347,018 | 8/1982 | Wrightson et al. . | |
| 4,395,794 | 8/1983 | Duncan | 15/420 |
| 4,660,248 | 4/1987 | Young . | |
| 4,773,121 | 9/1988 | Young . | |
| 4,779,303 | 10/1988 | Duthie et al. . | |
| 4,807,327 | 2/1989 | Jajko et al. . | |
| 4,831,684 | 5/1989 | Duncan | 15/347 X |
| 5,363,533 | 11/1994 | Young et al. . | |

FOREIGN PATENT DOCUMENTS

| | | | |
|---|---|---|---|
| 72039 | 2/1983 | European Pat. Off. | 15/415.1 |
| 0 083 840 | 7/1983 | European Pat. Off. | E01H 1/08 |
| 83840 | 7/1983 | European Pat. Off. | 15/340.3 |
| 33 16953 A1 | 11/1984 | Germany . | |
| 41 40 926 A1 | 6/1993 | Germany | E01H 1/04 |
| 41 43 123 A1 | 7/1993 | Germany | E01H 1/04 |
| 423 855 | 5/1966 | Switzerland . | |
| 124 871 | 5/1919 | United Kingdom . | |
| 1 068 938 | 5/1967 | United Kingdom . | |
| 2 164 378 | 9/1984 | United Kingdom | E01H 1/08 |
| 2 202 884 | 4/1987 | United Kingdom | E01H 1/08 |
| 8602394 | 4/1986 | WIPO | 15/340.1 |
| WO 87/01404 | 3/1987 | WIPO . | |

OTHER PUBLICATIONS

Brochure entitled Elgin Eagle—A new era in four–wheel mechanical street sweeping begins. (Sep. 1988).

*Primary Examiner*—Chris K. Moore
*Attorney, Agent, or Firm*—Leydig, Voit & Mayer, Ltd

[57] ABSTRACT

A street sweeper is provided including a vacuum pick-up head having a relatively low noise level and high sweeping efficiency resulting from the careful control of the velocity and direction of the air flow. In order to control the air flow, the internal contour of the pick-up head is optimized to accommodate the streamline flow pattern to minimize turbulence and boundary layer separation. The cross sectional area of the internal contour of the pick-up head is designed to be substantially constant or slightly converging. A support assembly for supporting a nozzle assembly is provided which minimizes damage to the pick-up head and minimizes infiltration into the pick-up head. A suction tube is also provided which minimizes the noise level and increases the efficiency of the pick-up head and the fan.

15 Claims, 9 Drawing Sheets

STREET SWEEPER PICK-UP HEAD

FIELD OF THE INVENTION

The present invention relates to street sweepers and, more particularly, to street sweepers that utilize a vacuum pick up head.

BACKGROUND OF THE INVENTION

Generally, conventional vacuum street sweepers and the like typically use at least one and preferably two side rotary brushes and a vacuum pick-up head corresponding to each rotary brush. As the sweeper passes over the surface to be cleaned, the side brushes dislodge and sweep the debris such as dirt, leaves, gravel and the like between the wheels, into the center and along the longitudinal axis of the sweeper, so that the vacuum pick-up head can convey the debris into a collection hopper. One example of such a vacuum street sweeper is the WHIRLWIND brand vacuum street sweeper of Elgin Sweeper Company, a subsidiary of Federal Signal Corporation of Elgin, Ill.

Typically, the pick-up head has a nozzle assembly for receiving and conveying the debris to a suction tube and ultimately to a collection hopper. The nozzle assembly typically has three sections—a lower or suction chamber, a middle section, and an upper section. The lower suction chamber or pick-up head chamber is a generally rectangular box-like chamber defined by front and rear inlets and lateral skid plates. Air is generally introduced into the suction chamber through the front and rear inlets. As the street sweeper moves forward, the nozzle assembly receives the debris through the front inlet at a speed generally equal to the forward velocity of the sweeper and the front air intake speed. The incoming rear inlet air acts to slow the debris from passing through the rear of the suction chamber in order to permit the vacuum the opportunity to pick-up the debris.

The top of the suction chamber is joined to a middle section which is generally in the shape of a pyramidal frustum. The top of the middle section, in turn, is joined to the third section which is a rectangular to circular transition member adapted to matingly attach to the suction tube. The suction tube is internally reinforced, typically with a helical wire or the like, to prevent the suction tube from collapsing in response to the vacuum exerted by the impeller fan located downstream of the collection hopper.

A support assembly is attached to the nozzle assembly for supporting the nozzle assembly during the vacuum operation and movement of the vehicle. The support assembly typically includes a linkage assembly attached between the front of the nozzle and the sweeper frame for pulling the nozzle assembly and a wheel assembly supporting the rear of the nozzle assembly.

Unfortunately, such street sweeper pick-up heads have several disadvantages. The opposing front and rear air inlets decrease the effectiveness and efficiency of the air fan. Conventional pick-up heads also have relatively high noise levels which may be a nuisance in residential and commercial neighborhoods. In addition, many pick-up heads are initially capable of picking debris off the ground surface, but subsequently unable to convey the debris completely into the collection hopper so that the debris is dumped onto the ground when the fan is turned off. Attempts to remedy this problem by using stronger fans are too costly and only exasperate the noise and efficiency problems. Another disadvantage with present pick-up heads is that they may be easily damaged due to uneven ground surface, such as train tracks, potholes, manhole covers and the like. Attempts to address this problem including raising the pick-up head when the sweeper is put in reverse is inconvenient. Other attempts to minimize the damage by using flexible shield members along the rear and sides of the suction chamber permit infiltration of air which adversely affects the efficiency and effectiveness of the pressure drop across the front inlet, and ultimately the fan.

SUMMARY AND OBJECTS OF THE INVENTION

One object of the present invention is to provide a street sweeper having increased effectiveness and efficiency which would provide better collection of debris from a street or surface.

Another object is to provide a street sweeper which minimizes the noise level due to the pick-up head.

A further object of the present invention is to provide an improved and more efficient pick-up head which permits the street sweeper to maximize the effectiveness of the fan.

A related object is to provide an improved suction tube which minimizes noise and increases efficiency.

Still another object of the present invention is to provide a pick-up head which may be efficiently manufactured using minimal components and efficient aerodynamic shapes.

Another object of the present invention is to provide a pick-up head which minimizes damage by uneven ground surfaces or objects protruding from the ground surface.

These and other features and advantages of the invention will be more readily apparent upon reading the following description of a preferred exemplified embodiment of the invention and upon reference to the accompanying drawings.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
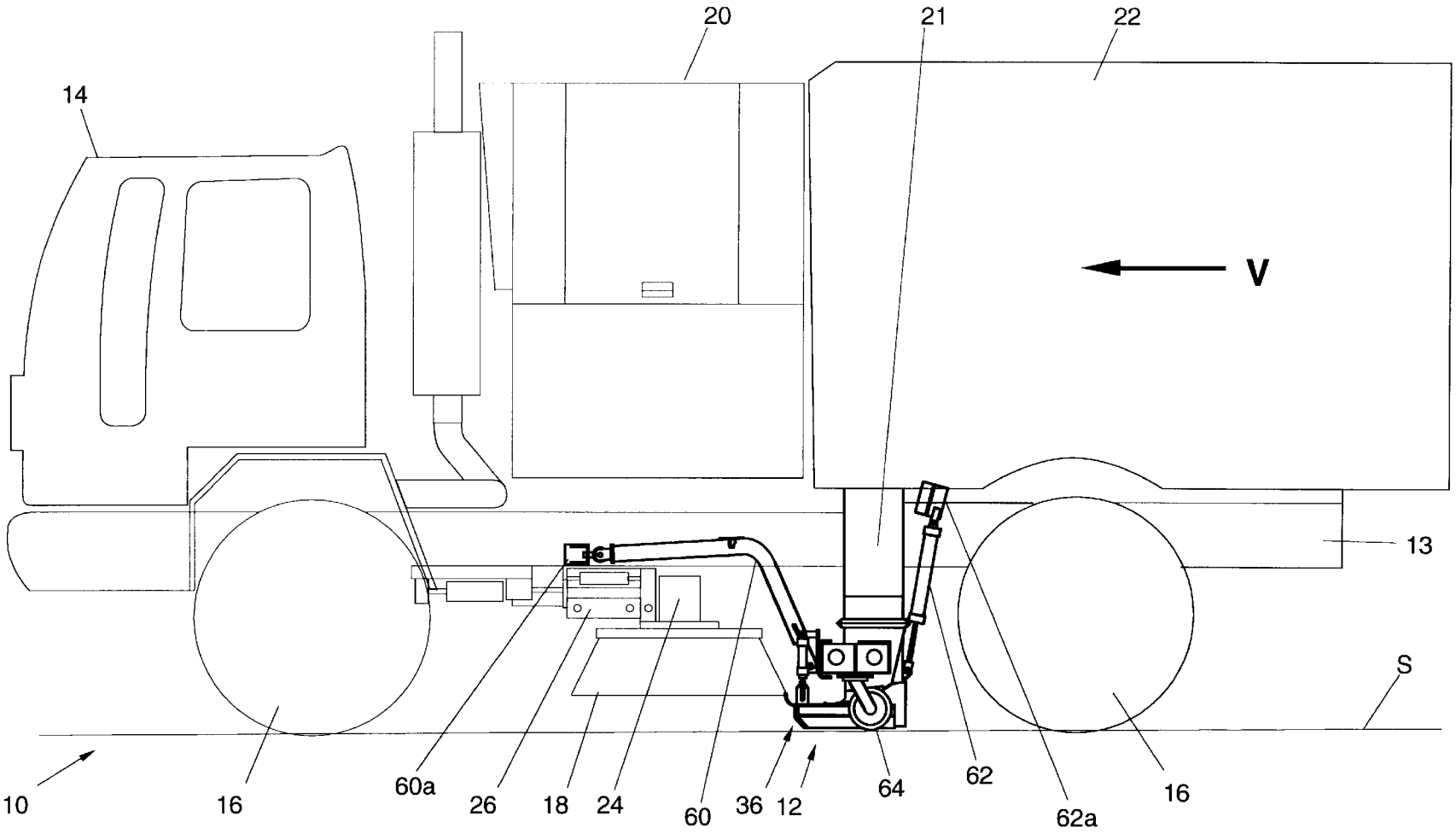
FIG. 1 is a side elevational view of a street sweeper having a vacuum pick-up head and a suction tube in accordance with the present invention.
Figure 2:
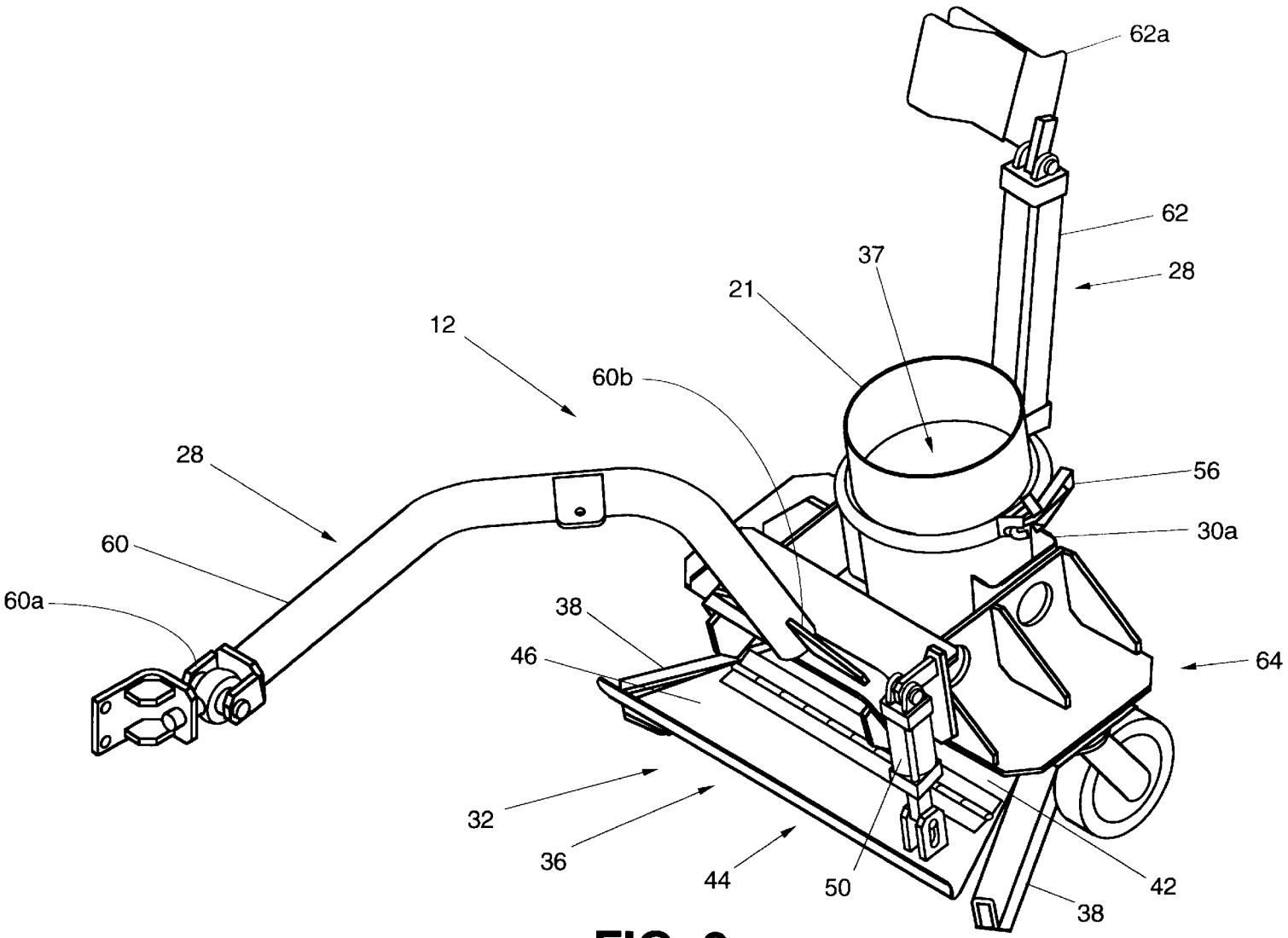
FIG. 2 is a perspective view of the vacuum pick-up head shown in FIG. 1.
Figure 3:
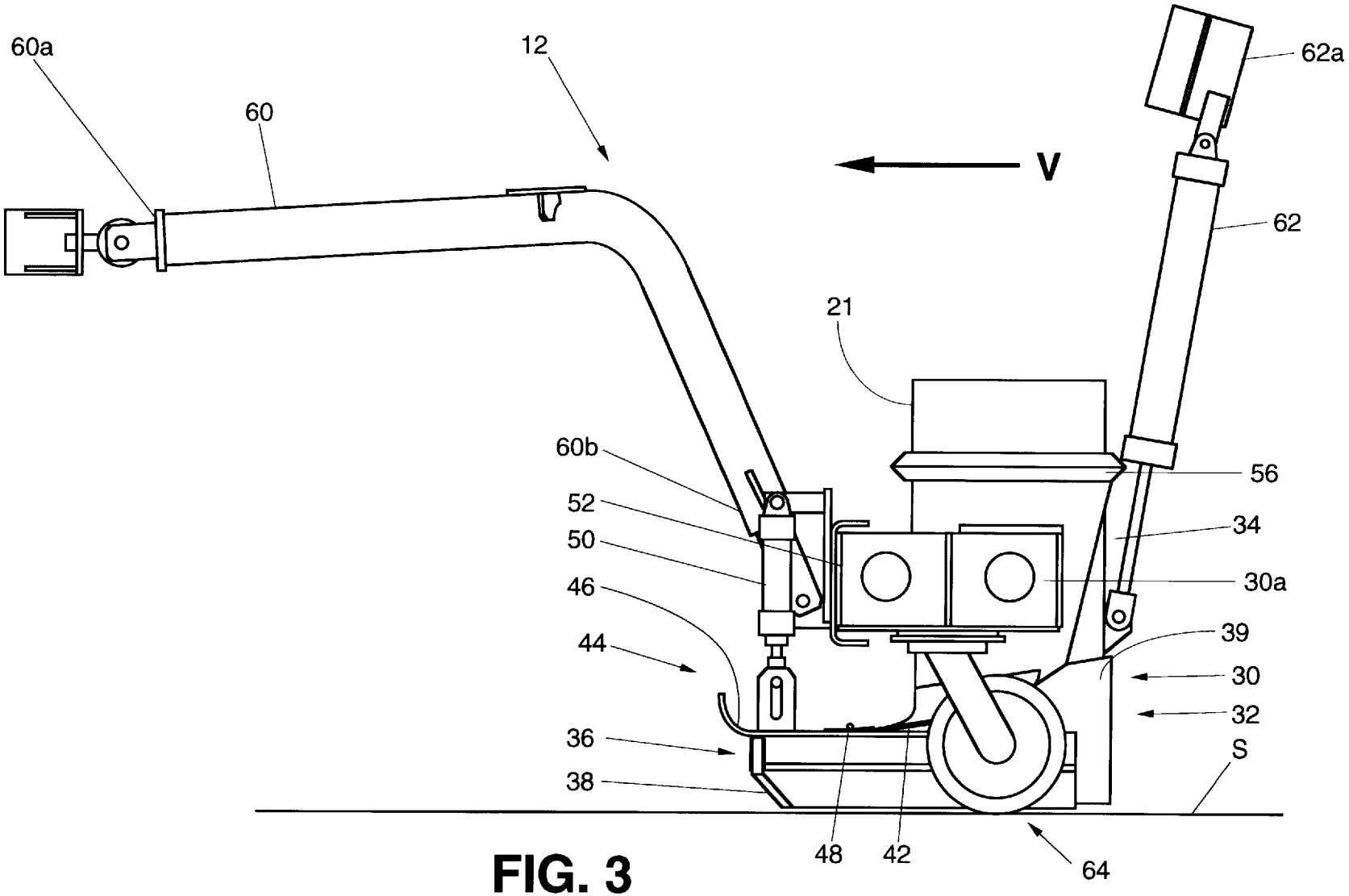
FIG. 3 is a side elevational view of the vacuum pick-up head shown in FIG. 1.

Referring to the drawings, and particularly to FIG. 1, there is shown a street sweeper 10 having a vacuum pick-up head 12 in accordance with the present invention. As is conventional, the street sweeper 10 comprises a standard truck chassis 13 carrying a cab 14, wheels 16, at least one, and preferably two conventional rotary side brushes 18, and a fan or air suction pump 20 which directs debris from the pick-up head 12 into a suction tube 21 and a collection hopper 22.

As the sweeper 10 travels over the surface S to be cleaned, the side brushes 18 may be rotated either clockwise or counter-clockwise by conventional hydraulic actuators 24 in order to dislodge and sweep debris such as dirt, leaves, gravel and the like between the wheels 16, into the center and along the longitudinal axis of the sweeper 10. The direction of the sweeper 10 is indicated by the arrow designated V. The brushes 18 are also pivotally attached to the chassis 13 so that a conventional brush linkage assembly 26 can lower or raise the brushes 18 for sweeping or high speed travel from site to site. Similarly, the linkage assembly 26 can regulate the pressure of the brushes 18 in order to accommodate debris of different sizes and types such as leaves, gravel, rocks or the like. The brushes 18 are also pivotally mounted so that the linkage assembly 26 can swing the brushes to the sides of the sweeper 10 in order to adjust the width of the path to be cleaned by the sweeper 10. The bristles of the brushes 18 may be made of any suitable material which is durable such as steel or polyurethane.

After the brushes 18 move the debris between the wheels 16, the debris is transported into a collection hopper 22. When full, the collection hopper 22 may be emptied into a dump truck for later disposal or the sweeper 10 may travel to a dumping area where the collection hopper 22 may be emptied.

Figure 7:
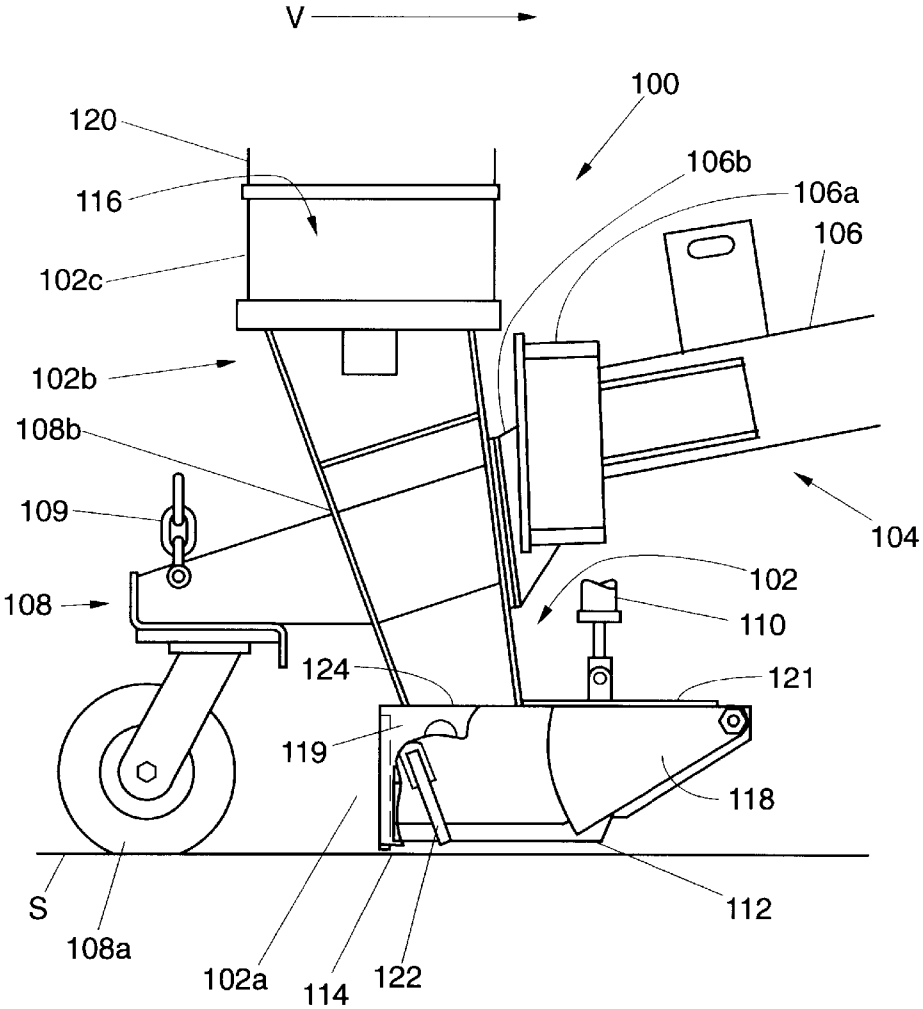
FIG. 7 Prior Art
FIG. 7 is a side elevational view of a conventional pick-up head.
Figure 8:
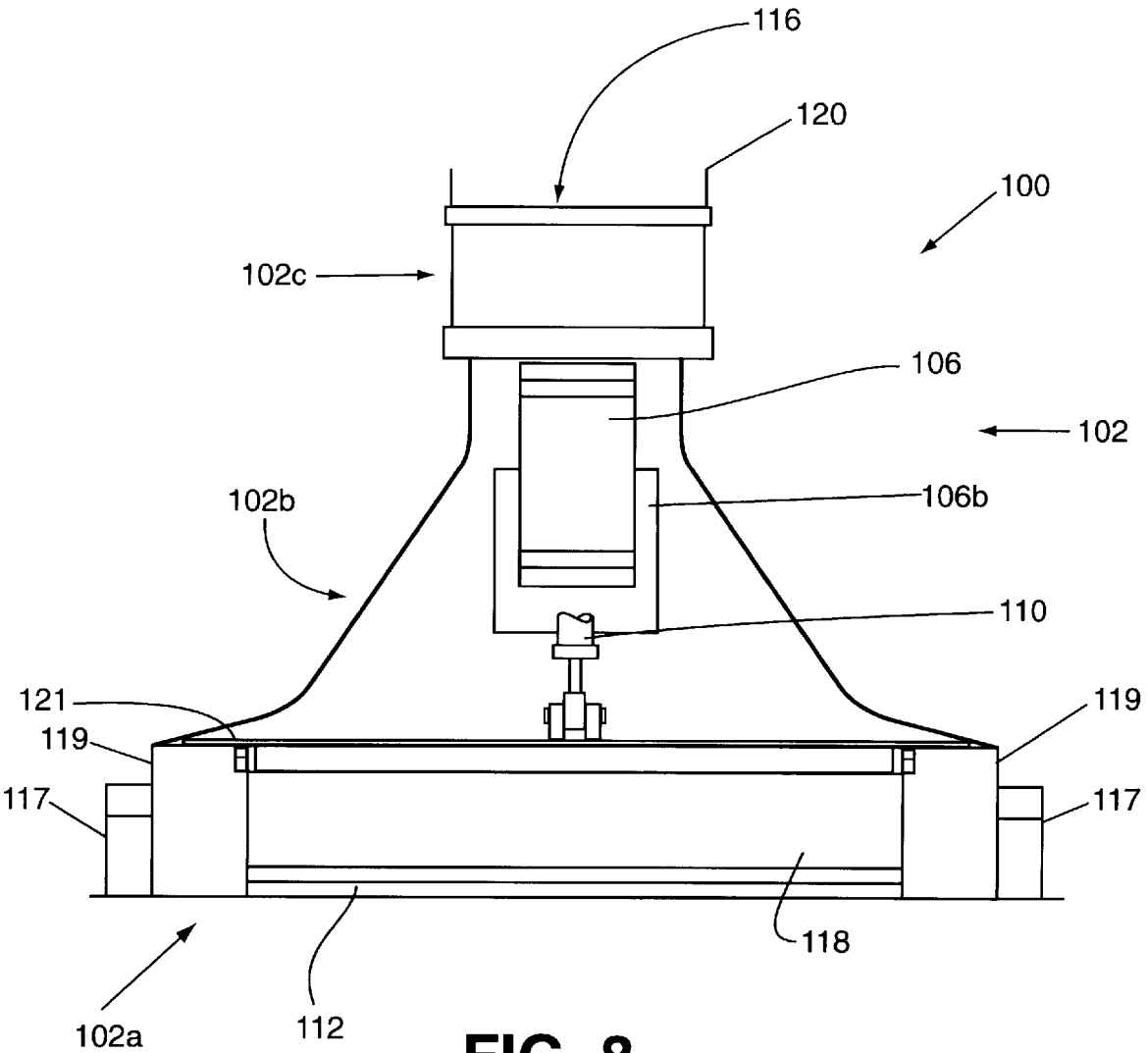
FIG. 8 Prior Art
FIG. 8 is a front elevational view of the pick-up head shown in FIG. 7.

FIGS. 7–8 illustrate a conventional vacuum pick-up head 100 typically used in vacuum street sweepers such the WHIRLWIND brand vacuum street sweeper made by Elgin Sweeper Company in Elgin, Ill. This pick-up head 100 typically has a nozzle assembly generally referenced as 102 suspended above the ground surface S by a support assembly 104.

In order to support the nozzle assembly 102 during operation, the support assembly 104 comprises a linkage assembly 106 attached to the front of the nozzle assembly 102 and the chassis 13 and a caster assembly 108 attached to the rear of the nozzle assembly 102. It will be appreciated that the nozzle assembly 102 may have rigid attachment members 106*b*, 108*b* to facilitate attachment to the linkage and caster assemblies 106, 108, respectively. The attachment member 108*b* at the rear of the nozzle assembly 102 is pivotally attached to the chassis 13 by a chain 109 and a conventional lifting actuator (not shown) in a known manner to permit the pick-up head 100 to be lowered and raised. The nozzle end 106*a* of the linkage assembly 106 is rigidly attached to the attachment member 106*b* to permit the nozzle assembly 102 to be pulled by the sweeper 10. The caster assembly 108 typically comprises a caster 108*a* or other type of wheel rearwardly spaced from the nozzle assembly 102.

Although the nozzle assembly 102 is generally suspended between the linkage and wheel assemblies 106, 108 above the ground surface S, the conventional support assembly 104 does not sufficiently protect the nozzle assembly 102 from damage when the sweeper 10 encounters uneven roadway surfaces such train tracks, manhole covers, cracks in the roadway and the like. Attempts to prevent such damage by having the lifting actuator (not shown) raise the nozzle assembly 102 above the surface S are inconvenient and unsatisfactory. Conventional skid plates 117 are connected by a plurality of nuts and bolts or the like (not shown) to the side walls 119 of the suction chamber 102*a* to hold the pick-up head 100 a predetermined distance above the surface S. The bottom of the skid plates 117 are typically made of a flexible yet durable material such as rubber which slidably engage the ground surface. Although the skid plates 117 and flexible flaps 114 disposed along the periphery of the suction chamber 102*a* have been used to minimize damage to the nozzle assembly 102, they permit infiltration of air into the lower section 102*a* of the nozzle assembly 102 which decreases the effectiveness of the nozzle section 102 and, ultimately, the efficiency of the fan 20.

The conventional nozzle assembly 102 has front and rear inlets 112, 114 and an upper outlet 116 disposed between the nozzle assembly and a conventional suction tube 120 which communicates with a collection hopper 22 and fan 20 located downstream of the suction tube 120. In order to transition from the inlets 112, 114 to the outlet 116, the nozzle assembly 102 has lower, middle and upper sections generally referenced as 102*a*, 102*b*, 102*c*, respectively. The lower section 102*a*, sometimes referred to as a pick-up chamber or suction chamber, comprises an elongated, box-like chamber which is generally defined by opposing side walls 119, the front and rear inlets 112, 114, and a top plate 121. Since the nozzle assembly 102 must fit under the chassis 13, the width of the suction chamber 102*a* is limited by the sweeper width, typically about 30 inches. The fan 20 creates a vacuum in the suction chamber 102*a* which draws air in through the front and rear inlets 112, 114. Referring to FIG. 8, the front inlet 112 is narrower than the suction chamber 102*a*.

As the street sweeper 10 moves forward during operation, the nozzle assembly 102 receives the debris through the front inlet 112 at a velocity generally equal to the street sweeper speed and the inlet air velocity. In order to adjust the inlet air velocity, the size of the front inlet 112 may be adjusted by a damper 118 pivotally attached to the top plate 121 in response to control by actuator 110. In contrast, the air drawn through the rear inlet 114 by the vacuum slows the incoming velocity of the debris so that the vacuum has the opportunity to direct the debris upwards through the relatively narrow opening 124 connecting the suction chamber 102*a* and the middle section 102*b* before the debris travels from the front inlet 112 through the rear inlet 114, which may only be about 6 inches. The rear inlet 114, extending along the length of the suction chamber 102*a*, typically has a fixed opening defined by the flexible flaps 122 typically on the order of 3/16 to ¼ inch high.

The suction chamber 102*a* may be fabricated by welding at least 4 plates together. The suction chamber 102*a* is typically welded to the middle chamber 102*b*, generally shaped in the form of a truncated pyramid formed by at least 4 plates which are also welded together. The third section 102*c* is a rectangular-to-circular transition element joining the truncated pyramid section 102*b* and the suction tube 120 together.

The conventional suction tube 120 used in the WHIRLWIND street sweeper shown in FIGS. 1–6 is made of a flexible tube, typically about 11 inches in diameter, which accommodates the movement of the pick-up head 100. An internal helical support wire (not shown) is disposed on the interior walls of tube 120 to withstand the vacuum exerted on the tube 120. It will be appreciated that the helical support wire forms internal ridges which create a vortex effect and turbulence which decreases the efficiency of the fan 20.

Conventional pick-up heads, including those of the type described in FIGS. 7–8, have several disadvantages. A significant problem is that conventional pick-up heads generate relatively high noise levels which are undesirable in residential and commercial neighborhoods. And, in many instances, the pick-up head may be capable of picking certain debris off the ground but is subsequently unable to convey the debris through the nozzle assembly and into the collection hopper so that the debris falls to the ground after the fan is turned off. The physical configuration of conventional pick-up heads also creates turbulence which decreases the efficiency and effectiveness of the fan 20. In the pick up head shown in FIGS. 7–8, for example, it will be readily appreciated that debris traveling through the nozzle assembly 102 passes through a series of passages and chambers with widely varying cross-sectional areas which induce large velocity variations and creates turbulence. As shown in FIG. 8, the front inlet 112 is narrower than the width of the suction chamber 102*a,* forming a short diverging passage, such that air expansion in the suction chamber 102*a* creates turbulence and decreases air velocity. The transition from the suction chamber 102*a* to the truncated pyramid of the middle section 102*b* subsequently increases the air velocity and also creates turbulence due to the sharp change from a horizontal air flow in the suction chamber 102*a* to the relatively vertical air flow in the middle section 102*b*. Furthermore, the air drawn through the opposing front and rear inlets 112, 114 inherently collide with and counteract each other, also contributing to the turbulence generation problem. Attempts to increase the effectiveness of the nozzle assembly by increasing the size and capacity of the fan are unsatisfactory because the larger fan is more costly, uses more energy, and is noisier than a smaller fan.

In accordance with one of the objects of the invention, a novel and improved vacuum pick-up head is provided having a relatively low noise level and high sweeping efficiency. FIGS. 1–6 illustrate one embodiment of a vacuum pick-up head 12 in accordance with the present invention. The illustrated pick-up head 12 comprises a support assembly 28 for suspending the nozzle assembly 30 (shown in FIG. 5) in proximity with the surface S to be cleaned.

Figure 4:
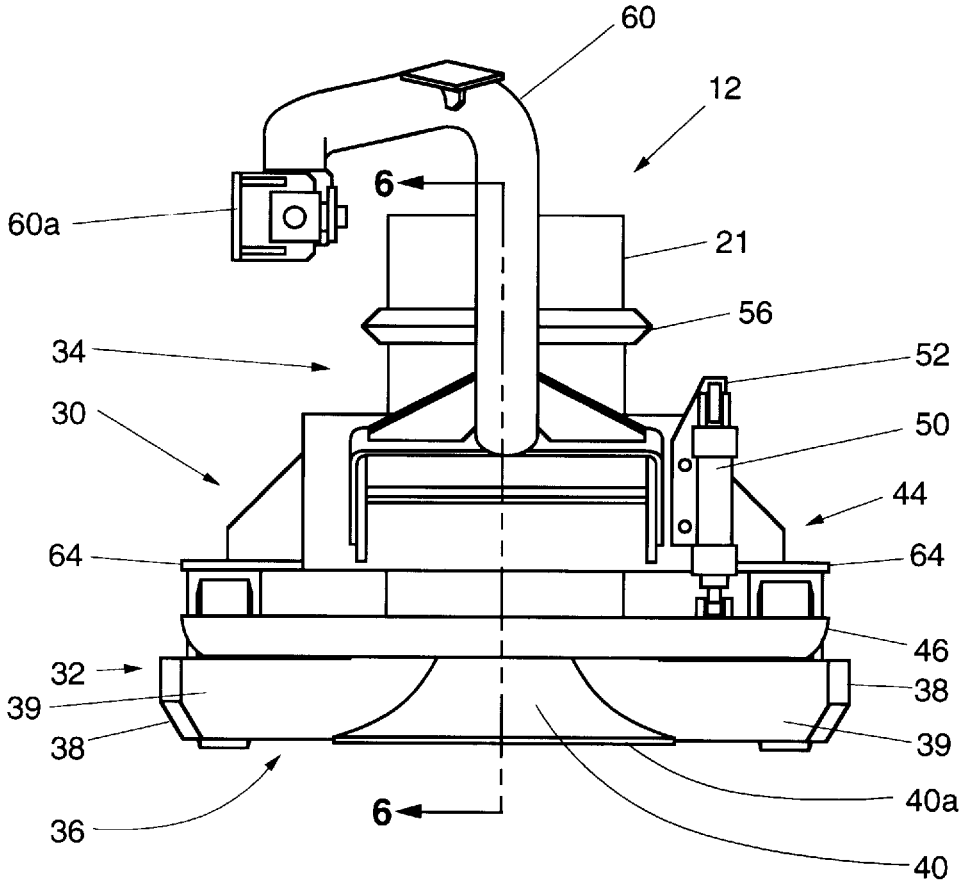
FIG. 4 is a front elevational view of the vacuum pick-up head shown in FIG. 1.
Figure 5:
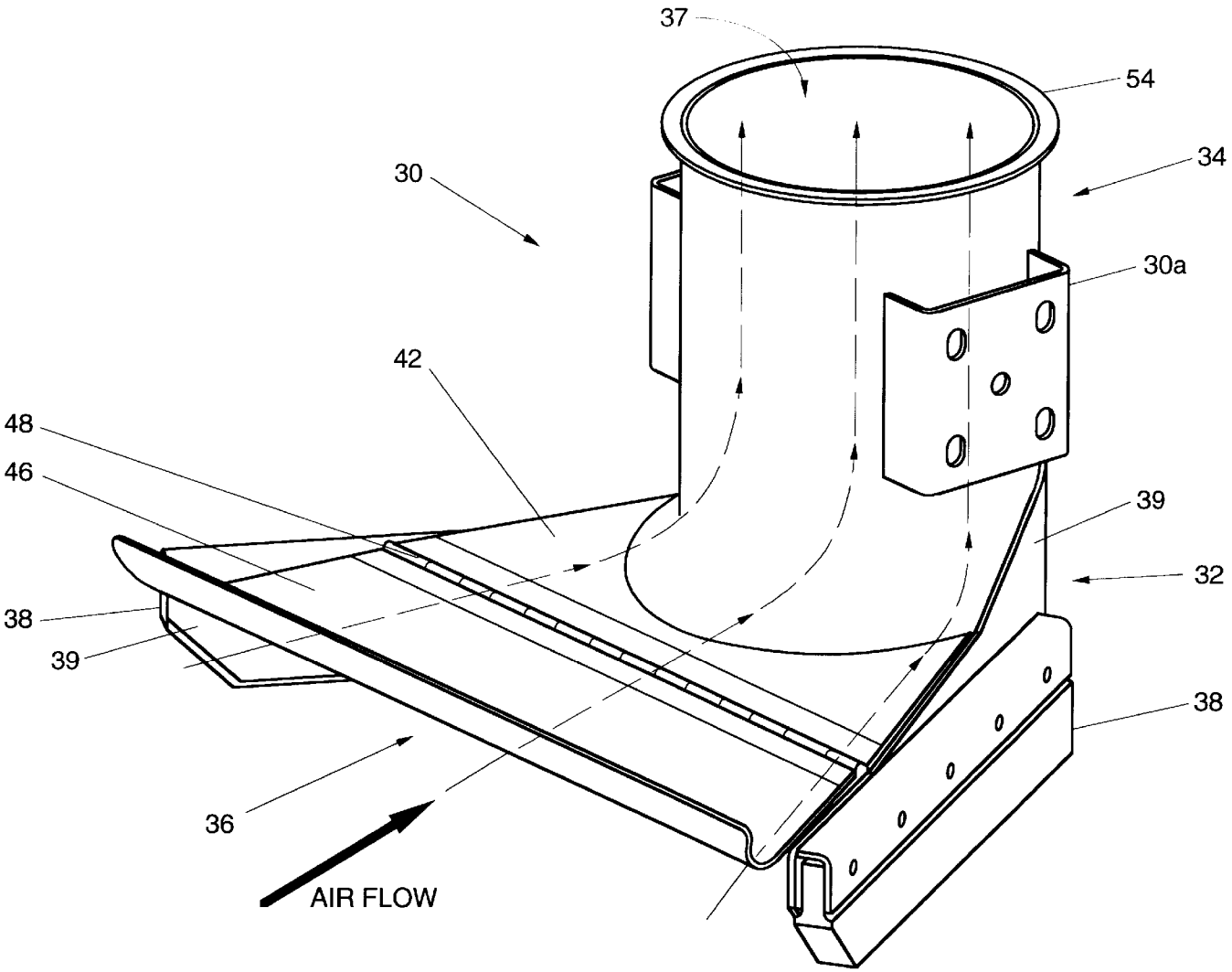
FIG. 5 is a perspective view of the nozzle assembly.
Figure 6:
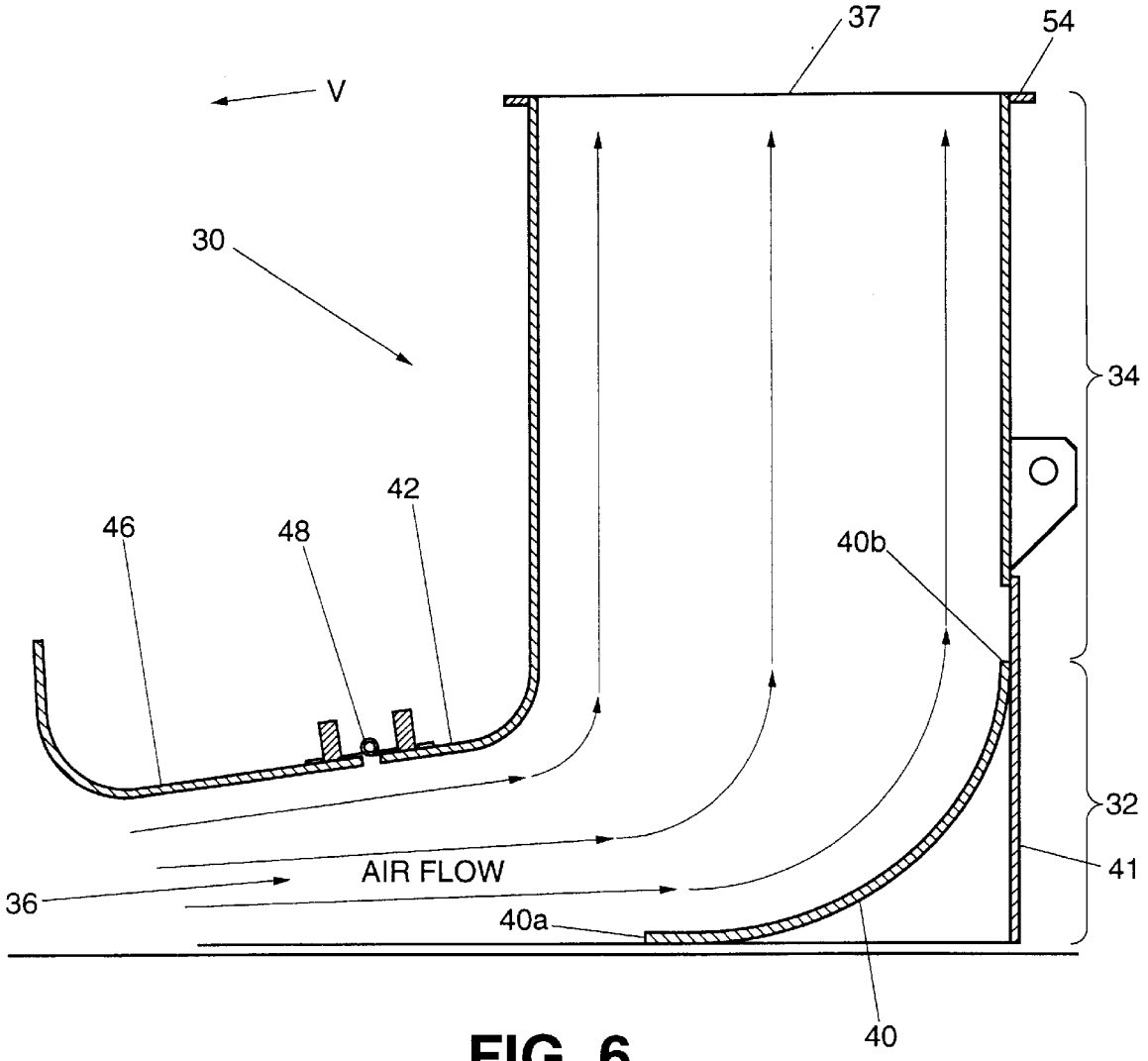
FIG. 6 is a cross-sectional view of the nozzle assembly taken along line 6—6 of FIG. 4.

Referring to FIGS. 5–6, it will be seen that the nozzle assembly 30 has a generally L-shaped cross-section including a bottom section generally referenced as 32 and an upper section generally referenced as 34. The bottom section 32 forms the generally horizontal suction chamber, which when viewed from the top, has a generally trapezoidal shape, defined by a front inlet 36, opposing and converging side walls 39 and an exterior vertical rear wall 41. The top of the chamber 32 is defined by the top plate 42. Referring to FIGS. 4–5, the side walls 39 converge to the arcuate rear wall 40 which has a front end 40*a* in close proximity to the ground S and a rear end 40*b* which transitions upwardly into the upper section 34. Skid plates 38 which are attached to the side walls 39 support the front end 40*a* of the arcuate wall 40 in close proximity with the ground S so as to minimize air flow through the rear of the suction chamber 32 or under the skid plates 38.

The upper section 34 has a circular cross section and outlet 37 which generally conform with the cross section of the suction tube 21. The outlet 37 disposed near the top of the upper section 34 communicates with the suction tube 21, the collection hopper 22 and the fan 20. The upper section 34 may have a flange 54 to permit the outlet 37 to be connected to the suction tube 21 in an airtight manner using conventional fasteners such as V-clamp 56, nuts or bolts and the like. The illustrated upper section 34 is substantially vertical but may be inclined in other embodiments of the present invention to minimize the transition from the horizontal air flow at the inlet 36 to vertical air flow at the outlet 37.

In accordance with one of the objects of the present invention, the pick-up head 12 may be easily manufactured. The nozzle assembly may be fabricated from four stamped sheet metal blanks and one circular spinning in contrast to the prior art pick-up head 100 which required multiple blanks to form the box-like suction chamber 102, the trapezoidal frustum in the middle section 102*b* and the rectangular to circular transition member in the third section 102*c*.

In accordance with another one of the objects of the present invention, the pick-up head 12 has a relatively low noise level and high sweeping efficiency resulting from the careful control of the velocity and direction of the air flow. In order to control the air flow, the cross sectional area of the nozzle assembly 30 remains substantially constant or slightly converging through either the suction chamber 32, the upper section 34, or both. The curvature of the rear wall 40 and the orientation of the converging side walls 39 may be designed to control the cross sectional area as desired. The smooth internal contour of the nozzle assembly 30 from the horizontal suction chamber 32 to the vertical upper section 34 minimizes the turbulence and non-laminar flow which cause the undesirable noise levels. The pick-up head 12 also prevents the changes in air velocity which reduce pressure drops which adversely affect the efficiency of the fan 20. The contour of the nozzle assembly 30 permits the velocity of the debris to remain relatively constant after it enters the suction chamber 32. Similarly, in the case of the slightly converging nozzle assembly 30, the debris may be slightly accelerated in order to assist the vacuum in moving it from the horizontal to the vertical direction.

It will be appreciated that the initial air velocity at the inlet 36 required to raise the debris off the ground is typically greater than the air velocity required to keep the debris moving through the nozzle assembly 30. The initial air velocity required to raise different size and types of debris off the ground will also vary. Thus, the nozzle assembly 30 preferably has means for adjusting the size of the inlet 36 in order to permit the pick-up head 12 to adjust the initial inlet air velocity. In the illustrated embodiment, the adjusting means or shutter assembly 44 comprises a shutter plate 46 pivotally attached to the front end of the top plate 42 by hinge 48 or the like. In order to control the size of the front inlet 36, one end of an actuator 50 is attached to the shutter plate 46 and the other end is attached to a support frame 52 located on the pick-up head 12. The front end 47 of the shutter plate 46 has an upwardly projecting arcuate member to minimize turbulence and noise generation at the inlet. A preferred front end 47 consists of a radius of approximately D/4 where D is the suction tube diameter.

In contrast with the prior art pick-up heads, the present pick-up head 12 has eliminated the inefficiencies inherently generated by the opposing front and rear inlets and the sharp transitions. For example, a pick-up head made in accordance with the present invention had a significant reduction in measured noise levels to about 96 decibels from about 104 decibels for the prior art pick-up head used in the WHIRLWIND street sweeper. It will be appreciated that the noise level is measured on a logarithmic scale and the 8 decibel reduction represents a 60% sound pressure reduction. The pick up head 12, as shown in FIGS. 1–6, had a cross sectional area which varied from about 105 square inches at the inlet to about 88.7 square inches at the outlet. The cross-sectional area of the suction chamber 32 varied from about 105 at the inlet 36 to about 91 square inches and the upper section 34 had a circular cross section which remained a constant 88.7 square inches. The width at the inlet 36 is about 30 inches to maximize the sweep path of the pick-up head 12. The distance from the inlet 36 to the rear wall 41 is about 22 inches which is significantly longer than the prior art pick-up head 120 and maximizes the opportunity for the vacuum to pick up the debris and minimizes the chance that the debris will pass through the rear of the suction chamber 32. It should also be appreciated that the shutter assembly 44 permits the cross sectional area at the inlet 36 to be varied.

The air flow in the pick-up head 12 is a three dimensional turbulent flow. Few attempts, if any, have been previously made using state of the art analytical techniques to analyze this flow and to optimize the pick-up head geometry. In accordance with one of the objects of the present invention, a method is provided for selecting design goals for the internal contour of a pick-up head 12 which optimally accommodates the streamline flow pattern to minimize turbulence and boundary layer separation. The selection of the design goals is accomplished by analyzing the flow field streamline patterns produced through the interaction of the vacuum system, which draws air through the pick-up head 12, and contouring the internal walls in accordance with the naturally occurring streamline patterns.

For two-dimensional, incompressible, irrotational flow, it is known that $$\frac{\partial^2\psi}{\partial x^2}+\frac{\partial^2\psi}{\partial y^2}=0$$

where $\psi$ is the streamline function. See generally Robert W. Fox and Alan T. McDonald, Introduction to Fluid Mechanics ($3^{rd}$ ed. 1985), see e.g. pp. 272–277). Since this equation is a form of Laplace's equations, any function that satisfies the streamline function, $\psi$, represents a possible two-dimensional, incompressible, irrotational flow field. Assuming that the vacuum source of the pick-up head 12 is an elementary sink in which flow is radially inward and the inlet 36 represents a uniform flow of constant velocity, U, in the x axis (in an xy plane), a fundamental first order approximation of a streamline function of the pick-up head 12 is described by, but not limited to:

$$\psi=U\ r\sin\theta-q\theta/2\pi$$

where q is the volume flow rate per unit area depth. The flow rate, q, is $2\pi rV$ where r is the radius from the sink and V is the radial velocity. Since the streamline function, $\psi$, is constant across a streamline, r may be calculated and graphically plotted for a given flow field.

Figure 9:
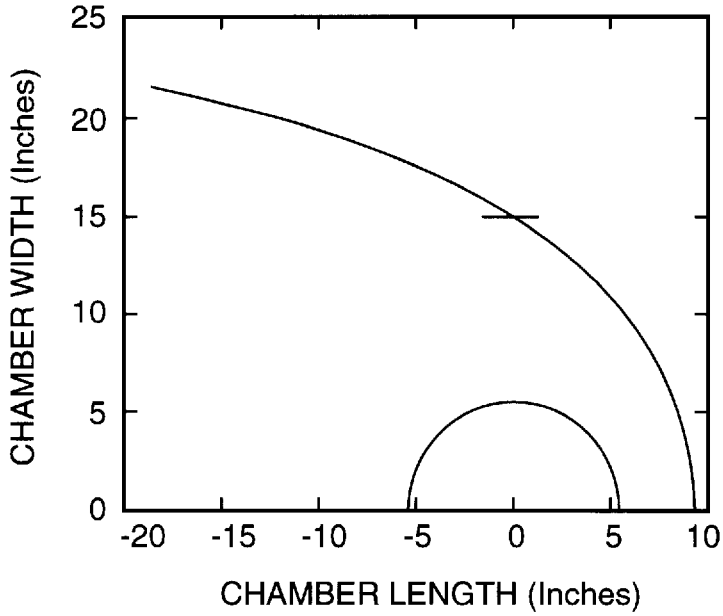
FIG. 9 is a stagnation streamline contour of an illustrative pick-up head.

FIG. 9 represents an illustrative stagnation streamline contour for a pick-up head which could to be used in a typical street sweeper having the following conditions: the width, length and height of the nozzle assembly is about 30×30×20 inches in order to fit under a chassis of a typical sweeper; the inlet is about 30 inches to maximize the sweep path; the street sweeper operates at about 25 mph; the suction tube is about 11 inches in diameter; and the fan draws about 9,000 cubic feet per minute.

The streamline profile shown in FIG. 9 represents the design goals for the internal contour of the pick-up head using the above design criteria. The nozzle contour width, represented by the y-axis is symmetric about the x-axis. Thus, the nozzle contour for the illustrative pick-up head would begin at 15 inches indicated by the horizontal line. The x-axis represents the distance from the hypothetical sink (at x=0). The semi-circle represents the suction tube diameter. The height of the nozzle assembly necessary to maintain a constant cross sectional area or a constant flow velocity may be determined since the nozzle width, y, is known. Similarly, the height and the width of the nozzle assembly may be varied to form a desired converging cross sectional area to increase the flow and debris velocity as it travels from the horizontal suction chamber to a vertical or inclined upper section. In most circumstances it would be undesirable to design a nozzle contour which is wider than the stagnation streamline profile illustrated in FIG. 9 because of the turbulence which would be generated. Although it is preferable that the pick-up head contour match the streamline profile to minimize boundary layer separation and turbulence, the actual contour may be adjusted to accommodate other design concerns. In order to accommodate manufacturing considerations, for example, it may be desirable to have straight walls instead of the arcuate shape represented by the streamline profile which may be relatively difficult to fabricate. Other considerations may include the actual operational characteristics of the sweeper. For example, most vacuum sweepers operate at speeds less than 25 mph, typically about 5 mph. Using the illustrated profile with a sweeper which operated at speeds less than 25 mph would cause turbulence in the nozzle assembly. The size of the inlet may also have to be varied to accommodate different sized debris or to generate different initial air velocities. The suction tube, presently centered at x=0 inches, may be moved to optimize the pick-up head performance, for example, by positioning the suction tube adjacent to the streamline profile to maximize the chamber length in order to permit the vacuum more opportunity to lift the debris into the suction tube. It should now be appreciated that, in accordance with one of the objects of the invention, this method will assist in the selection of design goals for a pick-up head which has a lower noise level and an increased efficiency over the prior pick-up heads.

Figure 10:
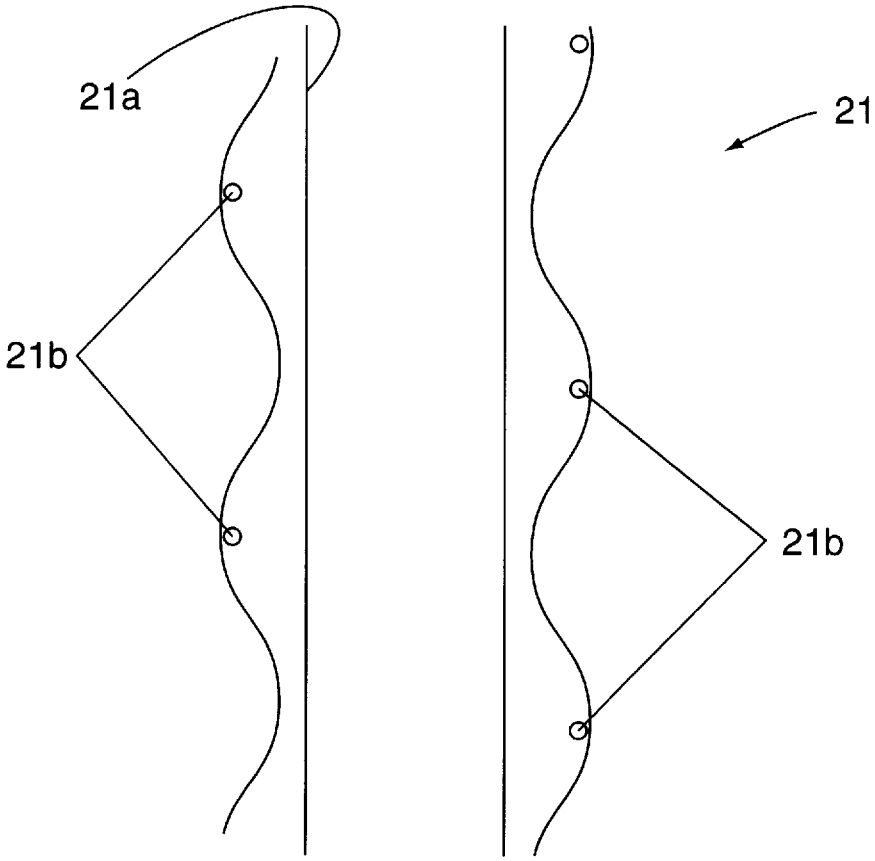
FIG. 10 is a cross-sectional view of a suction tube in accordance with the present invention.

In accordance with another object of the invention, a suction tube 21 is provided which minimizes noise and increases the efficiency of the fan. The suction tube 21 is flexible to permit the movement of the tube 21 resulting from movement of the pick-up head 12 on the cleaning surface S and when the pick-up head 12 is raised during transport. Referring to FIG. 10, the interior wall 21*a* of the suction tube 21 has a smooth contour to minimize turbulence and swirling flow patterns. In order to prevent the tube 21 from collapsing due to the internal vacuum, the suction tube 21 has circumferential or helical stiffening ribs 21*b* disposed on the external wall of the tube 21.

The support assembly 28 shown in FIGS. 1–4 comprises a linkage assembly 60 for pulling the front of the nozzle assembly 30, a lift actuator 62 attached to the rear of the nozzle assembly 30 for raising the nozzle assembly 30 during transport, and a wheel assembly 64 attached to the side of the nozzle assembly 30. The linkage assembly 60 is attached between the chassis 13 and the attachment member of the nozzle assembly. The chassis end 60*a* of the linkage assembly 60 is pivotally attached to the chassis 13 to accommodate vertical movement of the nozzle assembly 30 resulting from the actuator 62 or variations in the ground surface. The nozzle end 60*b* of the linkage assembly 60 is rigidly attached to the attachment member 20*a* of the nozzle assembly 30. The upper end 62*a* of the actuator is also attached to the chassis 13 while the lower end 62*b* is pivotally attached to the attachment member 30*a*.

The wheel assembly 64 comprises a pair of wheels 66 disposed on either side of the skid plates 38 and mounted to attachment members 30*a*. In accordance with one of the objects of the present invention, the axes of the wheels 66 are preferably mounted in proximity to the longitudinal axis of the front end 40*a* of the rear wall 40, thereby minimizing damage to the nozzle assembly. It will be appreciated that the wheels 66 maintain the front end 40*a* of the wall 40 a predetermined distance above the ground S. If the pick-up head 12 encounters uneven road surfaces S, the wheels 66 will raise or lower the front end 40*a* of the rear wall 40 and minimize damage thereto.

Thus, it will be seen that a novel and improved street sweeper nozzle has been provided which attains the aforementioned objects. Various additional modifications of the embodiments specifically illustrated and described herein will be apparent to those skilled in the art, particularly in light of the teachings of this invention. The invention should not be construed as limited to the specific form shown and described, but instead is set forth in the following claims.

We claim as our invention:

1. A street sweeper comprising:

a chassis, a collection hopper mounted to the chassis for receiving debris through a suction tube, a fan for generating a vacuum in the hopper and suction tube, a vacuum pick-up head in communication with the suction tube, the pick-up head having a nozzle assembly, the nozzle assembly having an upper section, a suction chamber in communication with the upper section, and an outlet in the upper section in communication with the suction tube, said suction chamber and upper section having respective internal cross sections, the suction chamber having an inlet at the front of the suction chamber in proximity with the ground, two converging sides, a top side, and an upwardly extending arcuate rear wall which translates into the upper section such that the areas of the respective internal cross sections of the suction chamber and the upper section remain substantially the same.

2. The street sweeper as set forth in claim 1 comprising means for adjusting the air velocity at the inlet in order to accommodate different debris sizes.

3. The street sweeper as set forth in claim 2 wherein the adjusting means comprises a shutter plate pivotally attached to the top side and an actuator for pivoting the shutter plate to vary the initial air velocity.

4. The street sweeper as set forth in claim 1 wherein the side walls and rear wall of the suction chamber form a substantially air-tight seal with the ground.

5. A street sweeper comprising:

a chassis, a collection hopper mounted to the chassis for receiving debris through a suction tube, a fan for generating a vacuum in the hopper and suction tube, a vacuum pick-up head in communication with the suction tube, the pick-up head having a nozzle assembly, the nozzle assembly having an upper section, a suction chamber in communication with the upper section, and an outlet in the upper section in communication with the suction tube, said suction chamber and upper section having respective internal cross-sections, the suction chamber having an inlet at the front of the suction chamber in proximity with the ground, two converging sides, a top side, and an upwardly extending arcuate rear wall which translates into the upper section such that the internal cross sectional area of the suction chamber steadily converges into the upper section.

6. The street sweeper as set forth in claim 5 comprising means for adjusting the size of the inlet for varying the air velocity at the inlet in order to accommodate different debris sizes.

7. The street sweeper as set forth in claim 6 wherein the adjusting means comprises a shutter plate pivotally attached to the top side and an actuator for pivoting the shutter plate to vary the size of the inlet and the initial air velocity.

8. The street sweeper as set forth in claim 5 wherein the side walls and rear wall of the suction chamber form a substantially air-tight seal with the ground.

9. A street sweeper comprising:

a chassis, a collection hopper mounted to the chassis for receiving debris through a suction tube, a fan for generating a vacuum in the hopper and suction tube, a vacuum pick-up head in communication with the suction tube, the pick-up head having a nozzle assembly, the nozzle assembly having an upper section, a suction chamber in communication with the upper section, and an outlet in the upper section in communication with the suction tube, said suction chamber and upper section having respective internal cross-sections, the suction chamber having an inlet at the front of the suction chamber in proximity with the ground, two sides, a top side, and an arcuate rear wall which translates from a front end in close proximity with the ground to a top end in the upper section, wherein the front end has a longitudinal axis, a support assembly for supporting the nozzle assembly above the ground having front and rear supports at the front and rear of the nozzle assembly, respectively, and a wheel assembly attached to the nozzle assembly such that the axis of the wheel remains substantially stationary with respect to the longitudinal axis of the front end of the rear wall for maintaining the front end of the rear wall above the ground in response to uneven ground levels.

10. The street sweeper as set forth in claim 9 wherein the suction chamber has an internal cross sectional area which remains substantially constant.

11. The street sweeper as set forth in claim 9 wherein the suction chamber has an internal cross sectional area which steadily converges.

12. The street sweeper as set forth in claim 9 comprising means for adjusting the size of the inlet for varying the air velocity at the inlet in order to accommodate different debris sizes.

13. The street sweeper as set forth in claim 12 wherein the adjusting means comprises a shutter plate pivotally attached to the top side and an actuator for pivoting the shutter plate to vary the size of the inlet and the initial air velocity.

14. The street sweeper as set forth in claim 9 wherein the side walls and rear wall of the suction chamber form a substantially air-tight seal with the ground.

15. A street sweeper comprising:

a chassis, a collection hopper mounted to the chassis for receiving debris through a suction tube, a fan for generating a vacuum in the hopper and suction tube, a vacuum pick-up head in communication with the suction tube, the pick-up head having a nozzle assembly, the nozzle assembly having an upper section, a suction chamber in communication with the upper section, and an outlet in the upper section in communication with the suction tube, said suction chamber and upper section having respective internal cross-sections, the suction chamber having an inlet at the front of the suction chamber in proximity with the ground, two sides, a top plate, and an arcuate rear wall which translates into the upper section, wherein the suction tube has a flexible wall for accommodating movement of the pick-up head during sweeper operation, a smooth internal bore, and a support member disposed on the exterior of the flexible wall for maintaining the shape of the tube and resisting the vacuum effects of the fan.

* * * * *